US011653710B2

(12) United States Patent
Lu

(10) Patent No.: US 11,653,710 B2
(45) Date of Patent: May 23, 2023

(54) CONSTRUCTION HELMET

(71) Applicant: Chien-Hung Lu, Tainan (TW)

(72) Inventor: Chien-Hung Lu, Tainan (TW)

( * ) Notice: Subject to any disclaimer, the term of this patent is extended or adjusted under 35 U.S.C. 154(b) by 199 days.

(21) Appl. No.: 17/137,906

(22) Filed: Dec. 30, 2020

(65) Prior Publication Data

US 2022/0202127 A1 Jun. 30, 2022

(51) Int. Cl.

| | |
|---|---|
| ***A42B 3/08*** | (2006.01) |
| ***A42B 3/14*** | (2006.01) |
| ***A42B 3/04*** | (2006.01) |
| *A42B 3/06* | (2006.01) |

(52) U.S. Cl.

CPC ..... *A42B 3/145* (2013.01); *A42B 3/0406* (2013.01); *A42B 3/08* (2013.01); *A42B 3/06* (2013.01)

(58) Field of Classification Search

CPC ..... A42B 3/145; A42B 3/0406; A42B 3/142; B65H 75/4402

USPC ..... 2/418

See application file for complete search history.

(56) References Cited

U.S. PATENT DOCUMENTS

2019/0000187 A1* 1/2019 Chen ..... B65H 75/4402
2019/0174872 A1* 6/2019 Kawano ..... B65H 75/38
2020/0253315 A1* 8/2020 Maloney ..... A42B 3/145

FOREIGN PATENT DOCUMENTS

TW 560257 U 11/2003

* cited by examiner

*Primary Examiner* — Timothy K Trieu

(57) ABSTRACT

A comfortable construction helmet easy to assembly and adjust is revealed. The construction helmet includes a support frame mounted therein and a head cushion fixed on the support frame for allowing a user's forehead to abut against. Left and right straps are extended from two sides of the support frame while an adjustment assembly is disposed between the left and right straps for adjusting the length of the straps. The adjustment assembly includes a base, a rotating member mounted in the base, an outer cap, and a toothed disc arranged over the rotating member and positioned in the outer cap. Two connecting strip are extended from two sides of the rotating member and connected to the left and right straps respectively. The toothed disc which is driven by the outer cap further drives the rotating member to rotate for changing the length of the connecting strips.

9 Claims, 11 Drawing Sheets

CONSTRUCTION HELMET

BACKGROUND OF THE INVENTION

Field of the Invention

The present invention relates to a construction helmet, especially to a construction helmet which allows a user to adjust the length of straps and provides a comfortable contact with a user's head. The design of the construction helmet can be applied to safety helmets, protective masks, and hats with support frames therein.

Description of Related Art

At the construction site, there are a lot of rope access works or obstacles on the road. The construction personnel may get head injuries caused by objects falling from heights or accidents resulted from collisions with obstacles on the road. Thus workers must wear safety helmets not only to decrease the risk for head injuries and protect themselves but also to comply with related regulations.

Most of safety helmets or the housing of protections masks are produced by plastic injection mode so that they have similar sizes and standards. However, people have different head types and various models of the safety helmets are required. While in use, adjustable straps for the safety helmets are easy to adjust the length for good and comfortable fit to a user's head and prevention of fall-off.

The adjustable strap is practical to use so that there are more different designs available now which are more convenient to use. For example, an improved adjustment structure of straps of a safety helmet is revealed in Taiwanese Pat. No. TW 560257(U). Yet this safety helmet has many components so that the assembling is getting difficult, the overall volume is larger and the production cost is even higher.

Thus there is room for improvement and there is a need to provide a novel construction helmet.

SUMMARY OF THE INVENTION

Therefore it is a primary object of the present invention to provide a construction helmet which allows a user to adjust the length of straps and provides a comfortable contact with a user's head. The design of the construction helmet can be applied to safety helmets, protective masks, and hats with support frames therein.

In order to achieve the above object, a construction helmet according to the present invention includes support frame mounted therein and an adjustment assembly. The support frame is provided with a head cushion being fixed thereon by easy fastening and used for allowing a user's forehead to abut against. Left and right straps are extended from two sides of the support frame while an adjustment assembly is disposed between the left and right straps for adjusting the length of the straps. The adjustment assembly includes a base, a rotating member mounted in the base, and a toothed disc arranged over the rotating member and positioned in an outer cap. Two connecting strip are extending from two sides of the rotating member and connected to the left and right straps respectively. The toothed disc which is driven by the outer cap further drives the rotating member to rotate for changing the length of the connecting strips. Thereby the construction helmet provides better comfort and ease of wearing.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Refer to FIG. 1-3, and FIG. 10, a construction helmet according to the present invention includes a support frame 1 mounted therein and an adjustment assembly 2. The support frame 1 consists of a forehead section 11 corresponding to a user's forehead and left and right straps 12 extended from two sides of the forehead section 11 respectively. The adjustment assembly 2 is disposed between the left and right straps 12 and used for adjustment of the length of the left and right straps 12.

Figure 2:
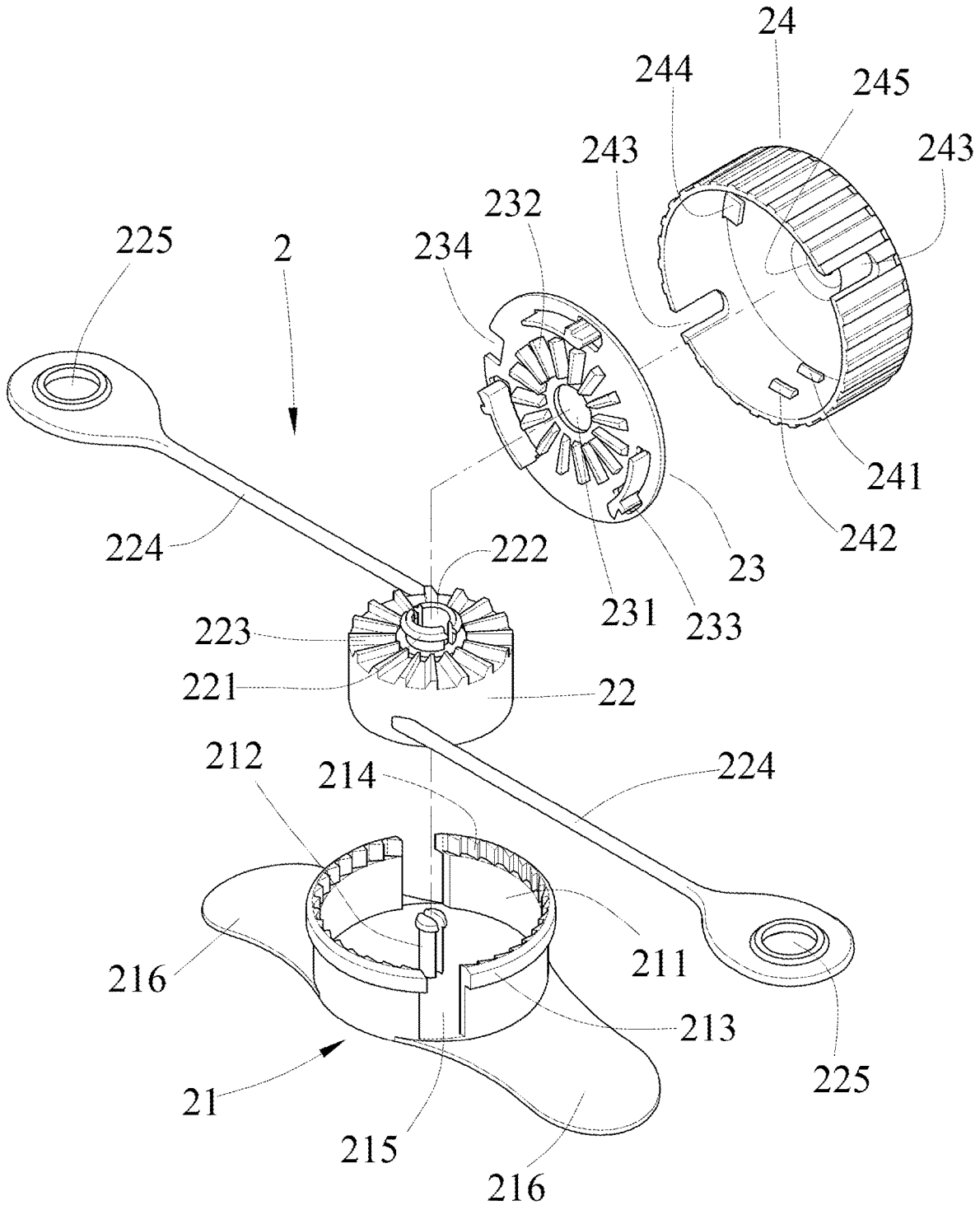
FIG. 2 is an explosive view of an adjustment assembly of an embodiment according to the present invention.

As shown in FIG. 2, the adjustment assembly 2 is composed of a base 21, a rotating member 22, a toothed disc 23, and an outer cap 24. The base 21 consists of a mounting space 211, a positioning pin 212 arranged at the center of the mounting space 211, a circular flange 213 disposed on an outer wall of the mounting space 211, a positioning teeth portion 214 formed circularly on an upper part of an inner wall of the mounting space 211, and two notches 215 formed on two opposite positions of the wall of the mounting space 211 respectively.

The rotating member 22 includes a snap portion 221 at the center thereof, a positioning hole 222 disposed in the snap portion 221, a radial teeth portion 223, two connecting strips 224, and two connecting holes 225. The positioning hole 222 is for mounting and positioning the positioning pin 212 therein and allowing the rotating member 22 to be mounted in the mounting space 211. A strap winding space (A) is formed between the rotating member 22 and the snap portion 221 while the radial teeth portion 223 is disposed on a surface of one end of the rotating member 22 and located around the snap portion 221. One end of the connecting strip 224 is extending from the rotating member 22 integrally and located at the position corresponding to the notch 215 for being mounted into the notch 215 while the other end (distal end) of the connecting strip 224 is provided with the connecting hole 225 used for connection with the strap 12.

The toothed disc 23 is provided with a mounting hole 231 which the snap portion 221 is mounted therein or released therefrom, a first teeth portion 232 arranged around the mounting hole 231 and used being engaged with the radial teeth portion 223, and at least one elastic locking tooth portion 233 corresponding to the positioning teeth portion 214.

The outer cap 24 is covering the base 21 and is composed of a plurality of locking and positioning member 241 arranged at an inner wall thereof for fixing the toothed disc 23 therein, a protruding locking block 242 disposed on the inner wall thereof and engaged with the circular flange 213 of the base 21 correspondingly, and two indentations 243 on the wall thereof for allowing the connecting strips 224 to pass through.

Figure 1:
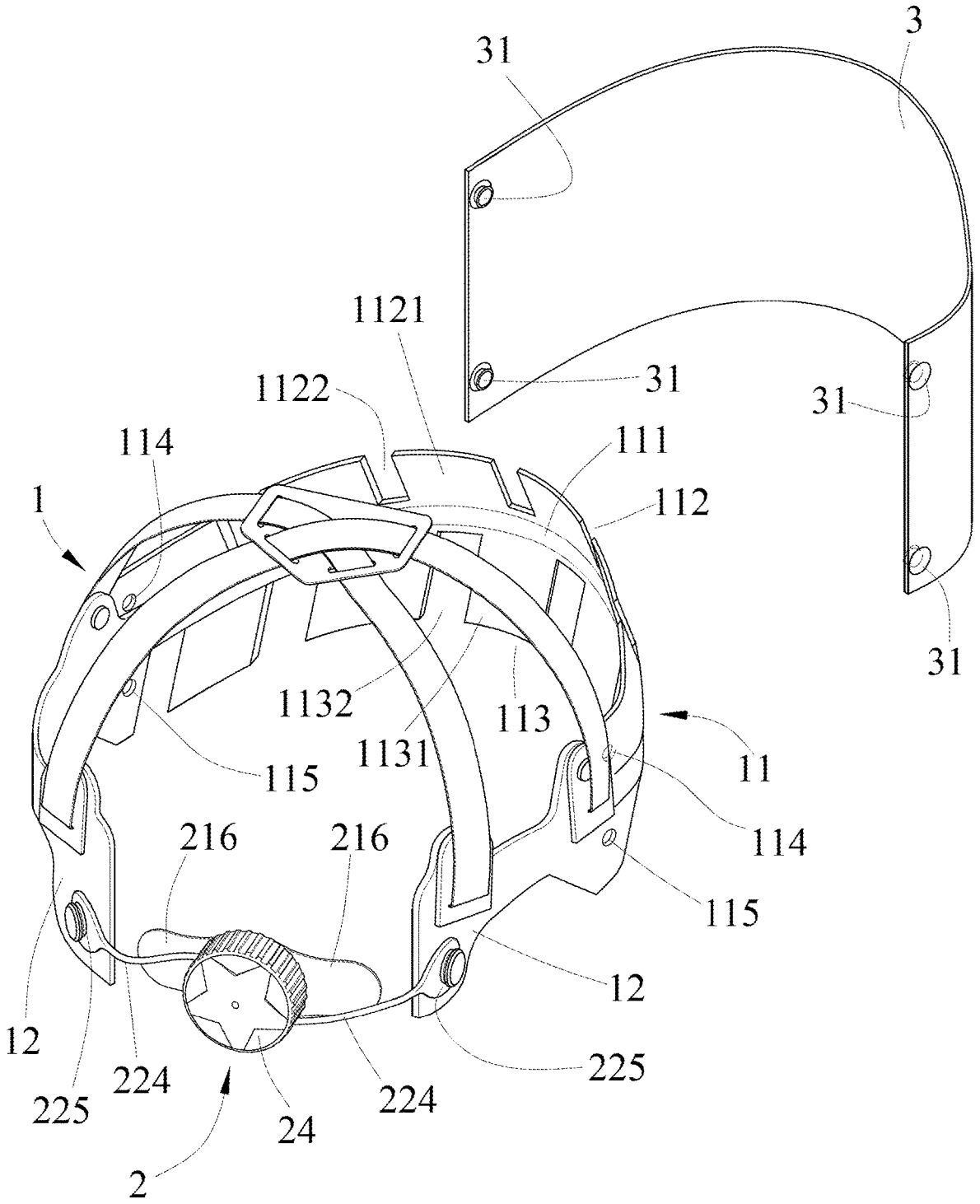
FIG. 1 is a perspective view of an embodiment according to the present invention.
Figure 8:
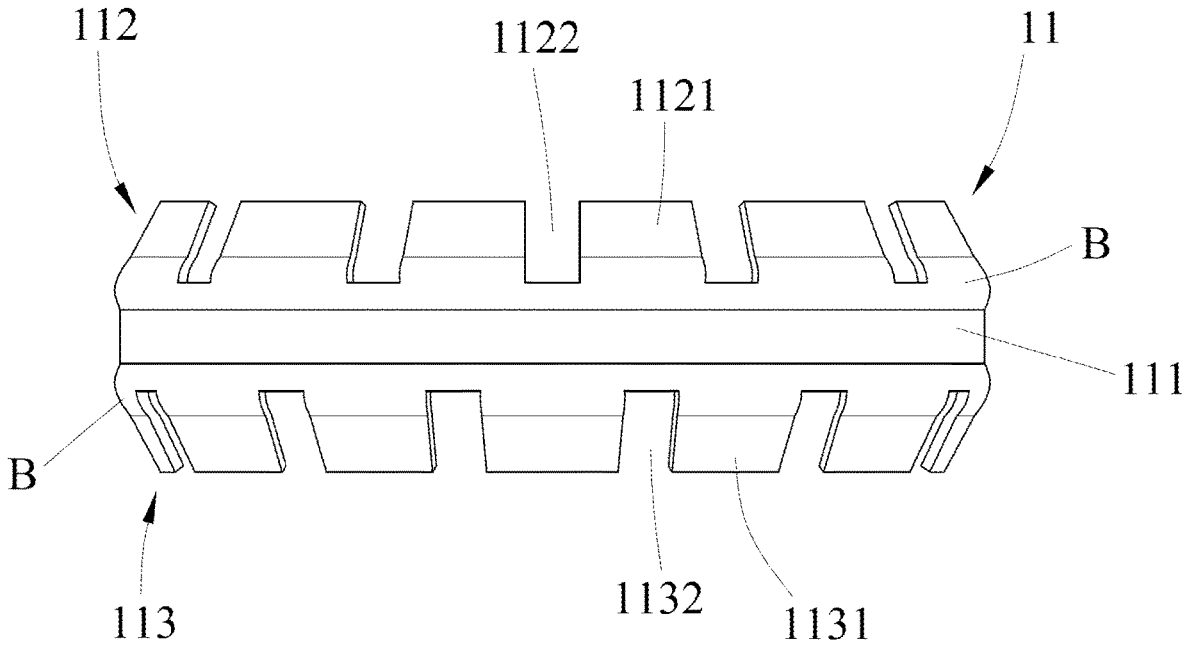
FIG. 8 is a schematic drawing showing a section of a head cushion of an embodiment according to the present invention.
Figure 9:
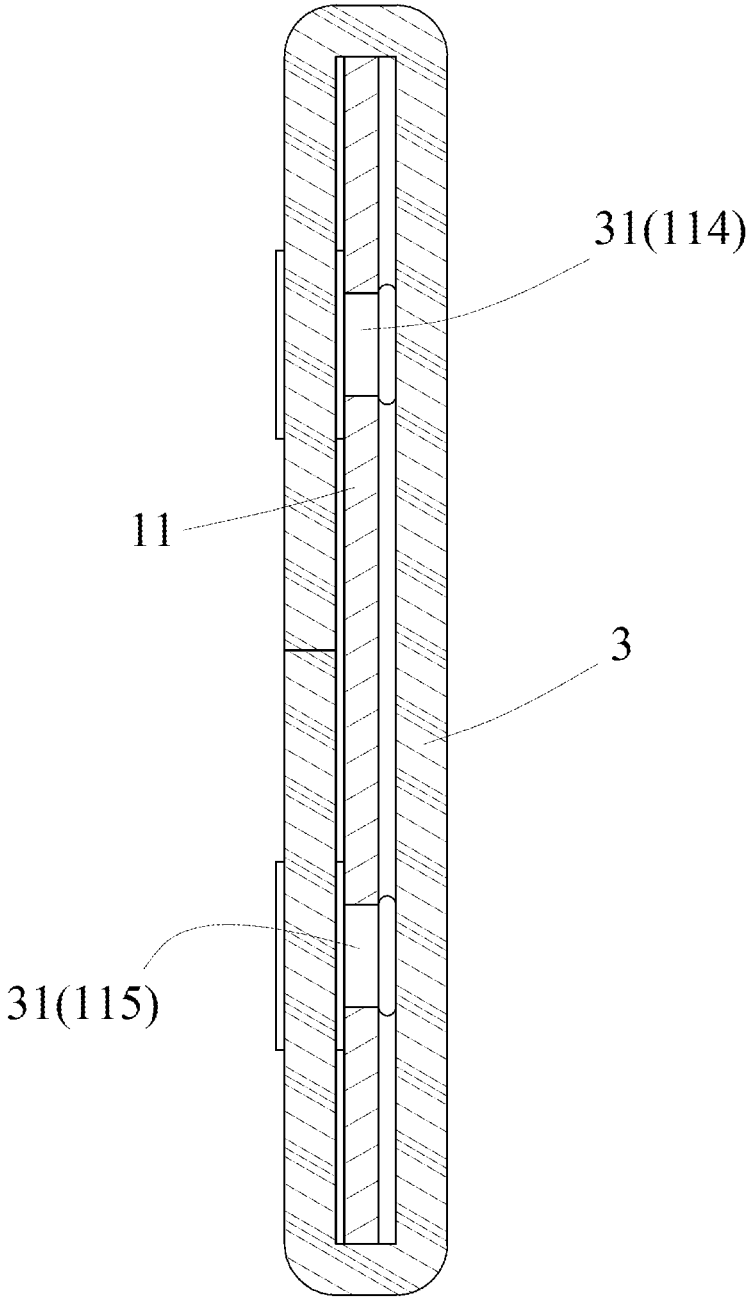
FIG. 9 is another schematic drawing showing a section of a head cushion of an embodiment according to the present invention.
Figure 10:
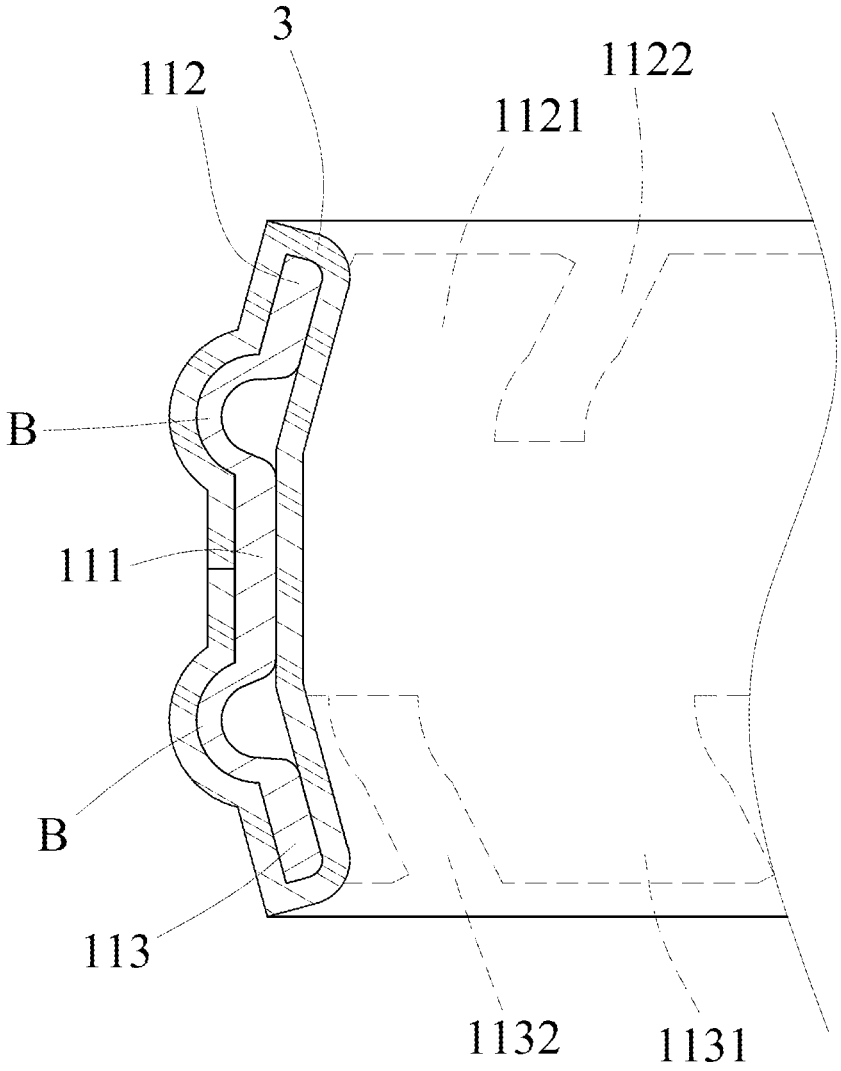
FIG. 10 is a partial sectional view of a forehead section of an embodiment according to the present invention.
Figure 11:
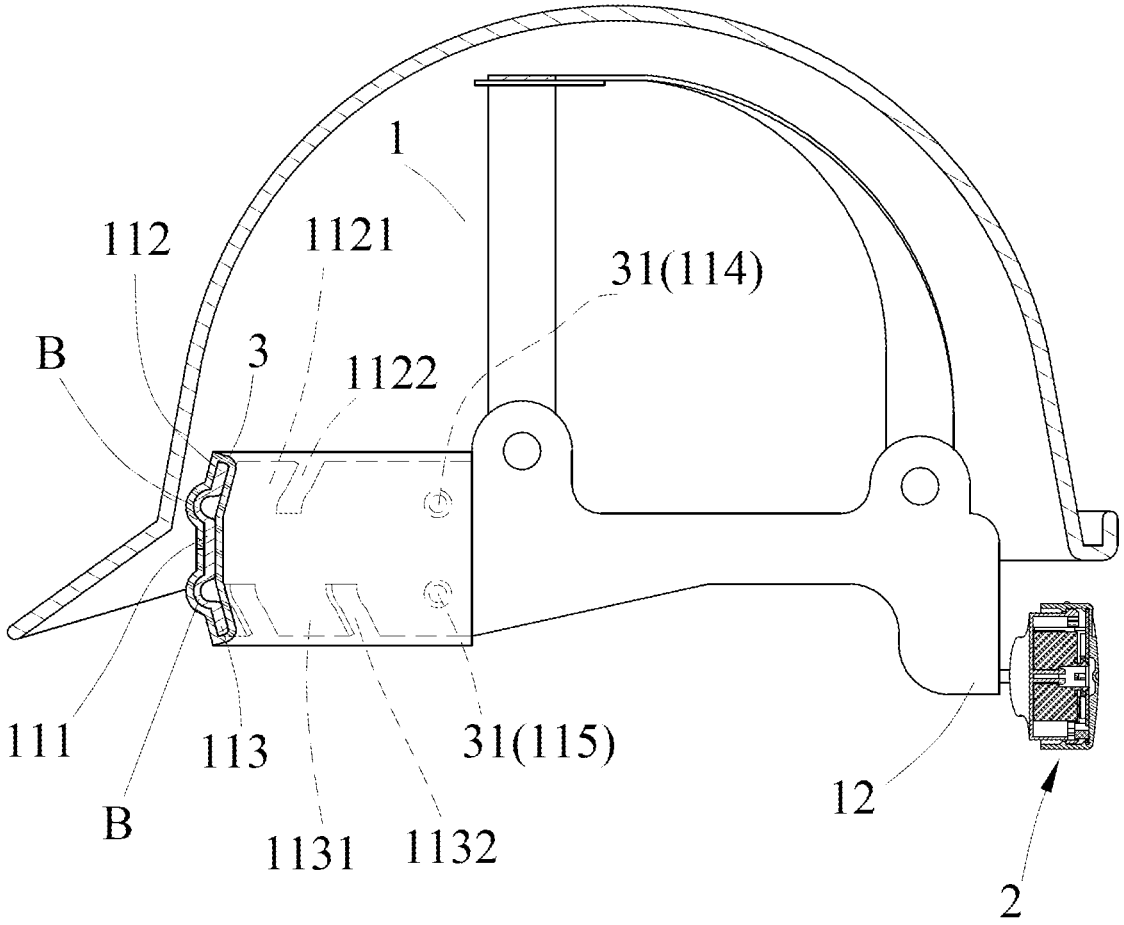
FIG. 11 is a schematic drawing showing a section of an embodiment being assembled according to the present invention.

While being assembled, refer to FIG. 1 and FIG. 8-11, a head cushion 3 is disposed on the forehead section 11 of the support frame 1 and used for allowing a user's forehead to abut against the construction helmet elastically and providing a user comfortable and soft feeling while in contact with the construction helmet. The head cushion 3 also allows sweat absorption. Refer to FIG. 1 and FIG. 8, the forehead section 11 consists of a straight segment 111, an upper elastic portion 112 and a lower elastic portion 113 extending upward and downward from the forehead section 11 respectively. The upper elastic portion 112 is provided with a plurality of upper elastic pieces 1121 and an upper notch 1122 is formed between the two adjacent upper elastic pieces 1121. The lower elastic portion 113 includes a plurality of lower elastic pieces 1131 and a lower notch 1132 is formed between the two adjacent lower elastic pieces 1131. The upper notches 1122 and the lower notches 1132 are in a staggered arrangement. The left side and the right side of the forehead section 11 are both provided with an upper hole 114 and a lower hole 115 while the head cushion 3 is provided with fasteners 31 disposed on the position corresponding to the upper and the lower holes 114, 115. While mounting the head cushion 3 to the forehead section 11, first two of the fasteners 31 of the head cushion 3 are inserted and positioned in the upper holes 114 or the lower holes 115. Then the head cushion 3 is wrapped around the straight segment 111, the upper elastic portion 112, and the lower elastic portion 113 from inside to outside for covering the forehead section 11 therein. Next the rest two of the fasteners 31 are inserted and mounted in the lower holes 115 or the upper holes 114, as shown in FIG. 9. Thereby the forehead section 11 is enclosed in the head cushion 3 easily, as shown in FIG. 10 and FIG. 11.

When a user wear the construction helmet, the construction helmet is abutting against the user with different head circumferences with the assistance of elasticity from the upper elastic portion 112 and the lower elastic portion 113. Elastic curved portions B are further formed at the positions where the upper elastic portion 112 and the lower elastic portion 113 are connected to the straight segment 111, as shown in FIG. 8, FIG. 10, and FIG. 11. Owing to the optimal elasticity provided by the elastic curved portions B, the present construction helmet is better fit and more comfortable for a user's head with different circumferences while in contact with the head cushion 3.

Figure 3:
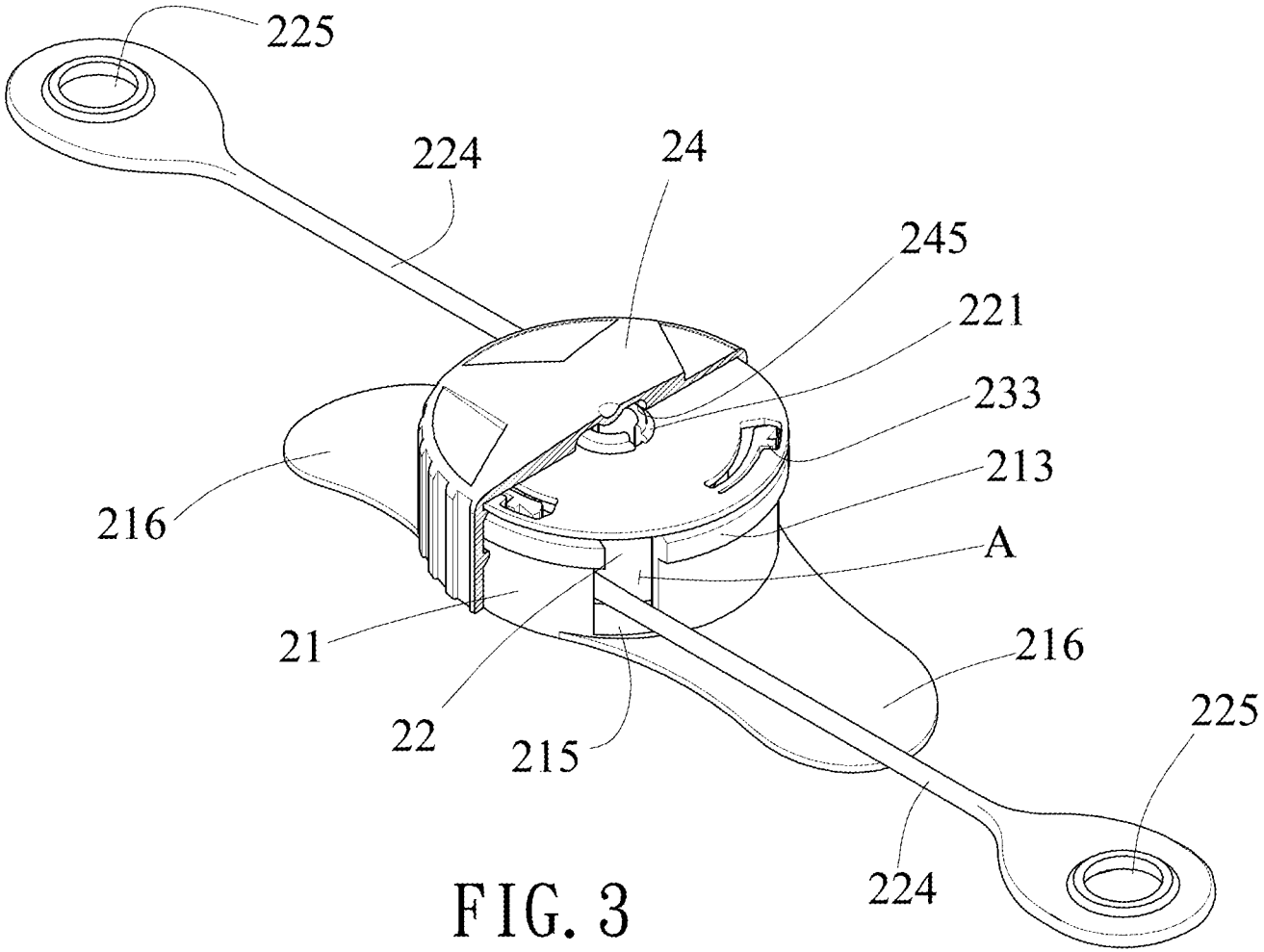
FIG. 3 is a perspective view of an adjustment assembly of an embodiment according to the present invention.

Refer to FIGS. 1-3, during assembly of the adjustment assembly 2, the rotating member 22 is mounted into the mounting space 211 of the base 21 and the positioning pin 212 is inserted into the positioning hole 222 of the rotating member 22 for fixing the rotating member 22 inside the mounting space 211. At the same time, the connecting strips 224 are passed through the notches 215 on the wall of the base 21 correspondingly and then the connecting holes 225 on the distal end of the respective connecting strips 224 are connected to the left and right straps 12 of the support frame 1 respectively. Next the toothed disc 23 is pushed into the locking and positioning members 241 on the inner wall of the outer cap 24 for being fastened in the outer cap 24 by the locking and positioning members 241. The circumference of the toothed disc 23 is provided with a nick 234 while the inner wall of the outer cap 24 is provided with a protruding block 244 corresponding to the nick 234. The protruding block 244 is mounted and locked in the nick 234 so that the toothed disc 23 is able to be rotated along with the outer cap 24. The outer cap 24 is placed on the base 21 for covering the base 21 and the protruding locking block 242 of the outer cap 24 is engaged with the circular flange 213 of the base 21 correspondingly while the connecting strip 224 of the rotating member 22 is passed through the indentation 243. The outer cap 24 is further provided with a concave portion 245 in which the snap portion 221 of the snap portion 221 are mounted.

Figure 4:
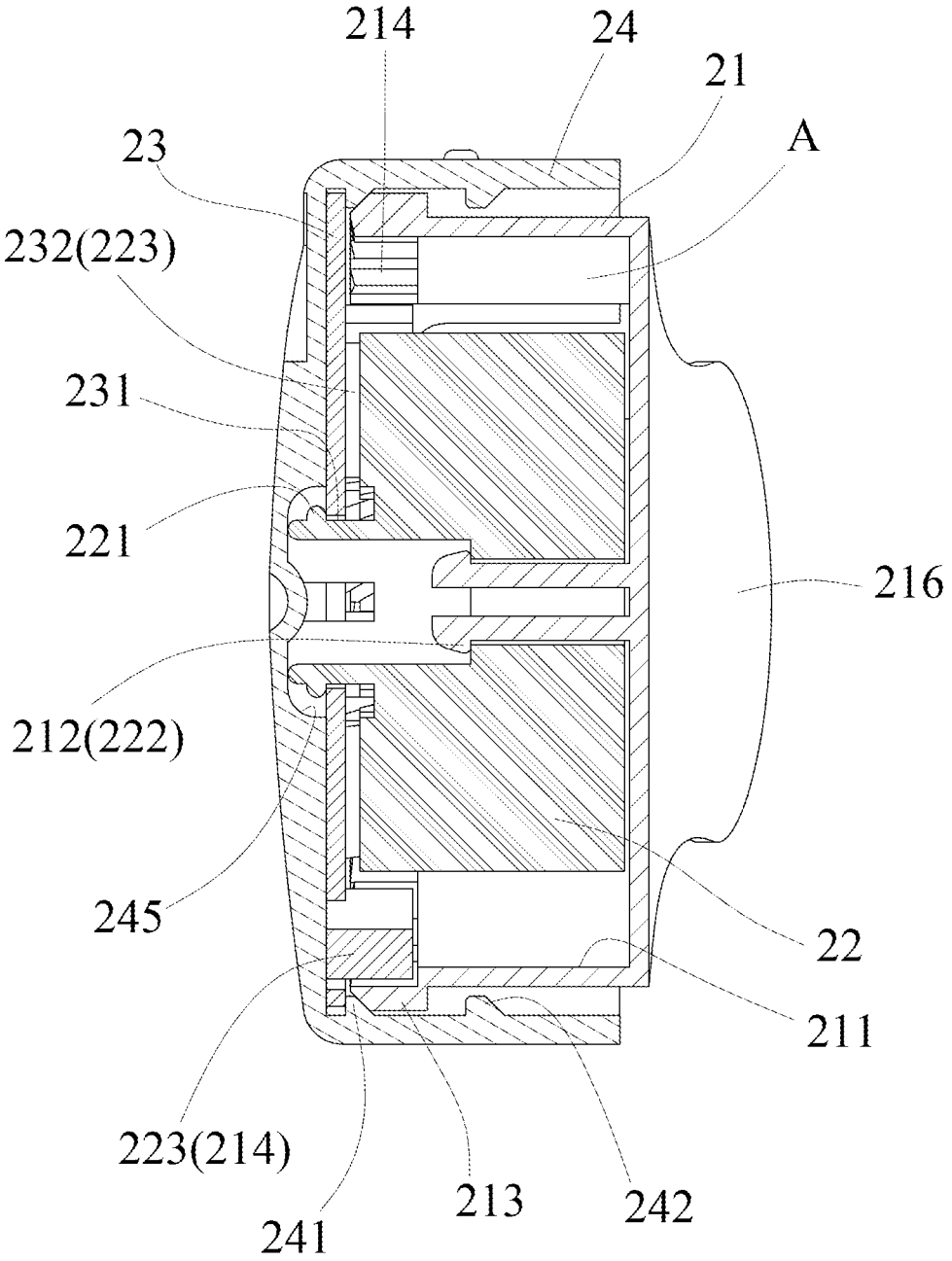
FIG. 4 is a sectional view of an adjustment assembly of an embodiment according to the present invention.
Figure 5:
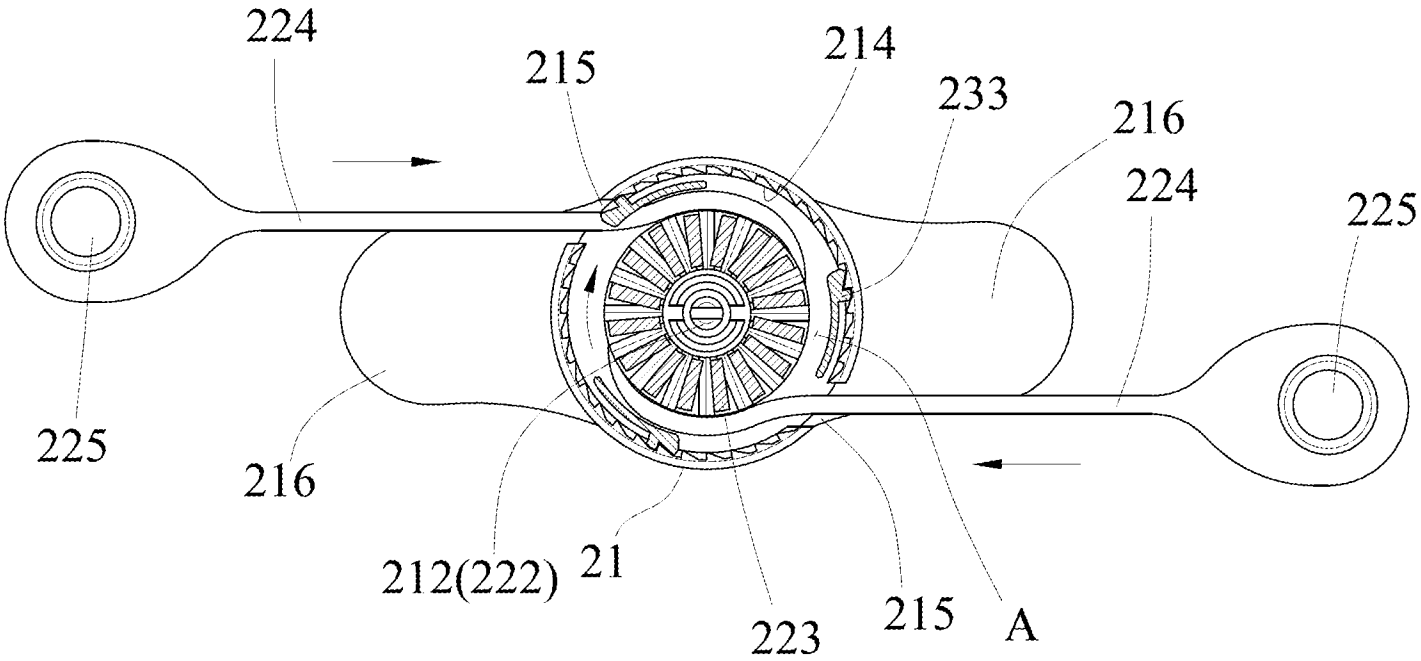
FIG. 5 is a top view of an adjustment assembly of an embodiment according to the present invention.

As shown in FIG. 4, after the assembly of the adjustment assembly 2 being completed, the outer cap 24 is in the pressed state. At the moment, the snap portion 221 is mounted and locked in the mounting hole 231 of the toothed disc 23 while the first teeth portion 232 of the toothed disc 23 is engaged with the radial teeth portion 223 of the rotating member 22 and the elastic locking tooth portion 233 of the toothed disc 23 is also engaged with the positioning teeth portion 214 of the base 21. By the engagement of the first teeth portion 232 with the radial teeth portion 223 in combination with the engagement of the elastic locking tooth portion 233 with the positioning teeth portion 214, the rotating member 22 can be securely positioned without retrograde rotations.

While the length of the left and right straps 12 is adjusted by a user, the outer cap 24 is rotated and the toothed disc 23 is further driven to rotate by the outer cap 24. Thus the first teeth portion 232 drives the radial teeth portion 223 engaged therewith to rotate and the radial teeth portion 223 further drives the rotating member 22 to rotate along with the outer cap 24. While the rotating member 22 is rotated, the connecting strips 224 are wound around the rotating member 22 in the strap winding space (A). Thereby the length of the connecting strips 224 is changed. During the length adjustment process, the elastic locking tooth portion 233 of the toothed disc 23 is able to rotate along with the first teeth portion 232 without being limited due to its elasticity when the first teeth portion 232 is rotated clockwise. After completing the adjustment and the outer cap 24 is no more rotated, the rotating member 22 starts turning back. By the elastic locking tooth portion 233 being engaged with the positioning teeth portion 214 of the base 21, the rotating member 22 is positioned and unable to turn back for maintaining the length of the connecting strips 224 after the adjustment, as shown in FIG. 4.

Figure 6:
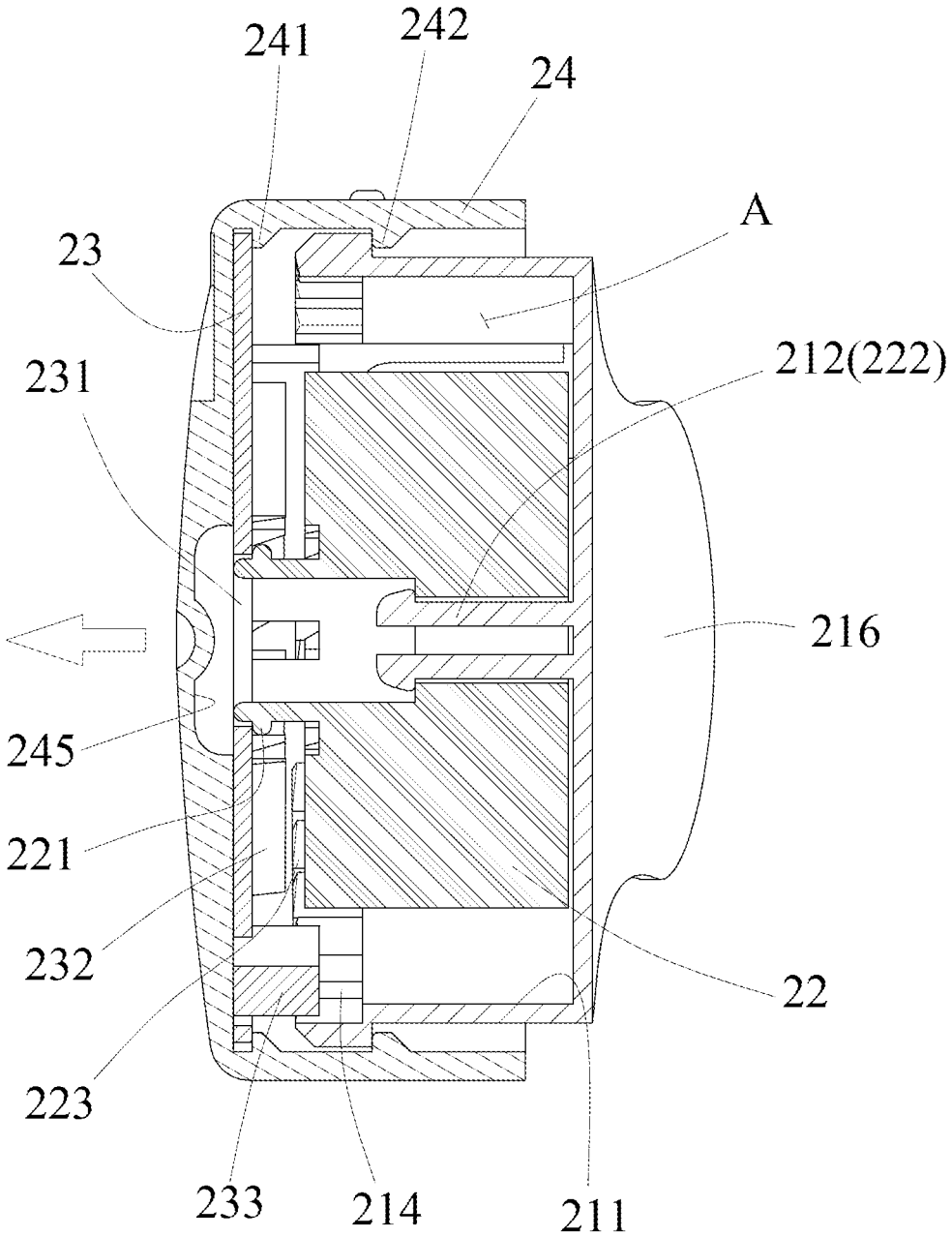
FIG. 6 is a sectional view of an adjustment assembly being operated and used of an embodiment according to the present invention.
Figure 7:
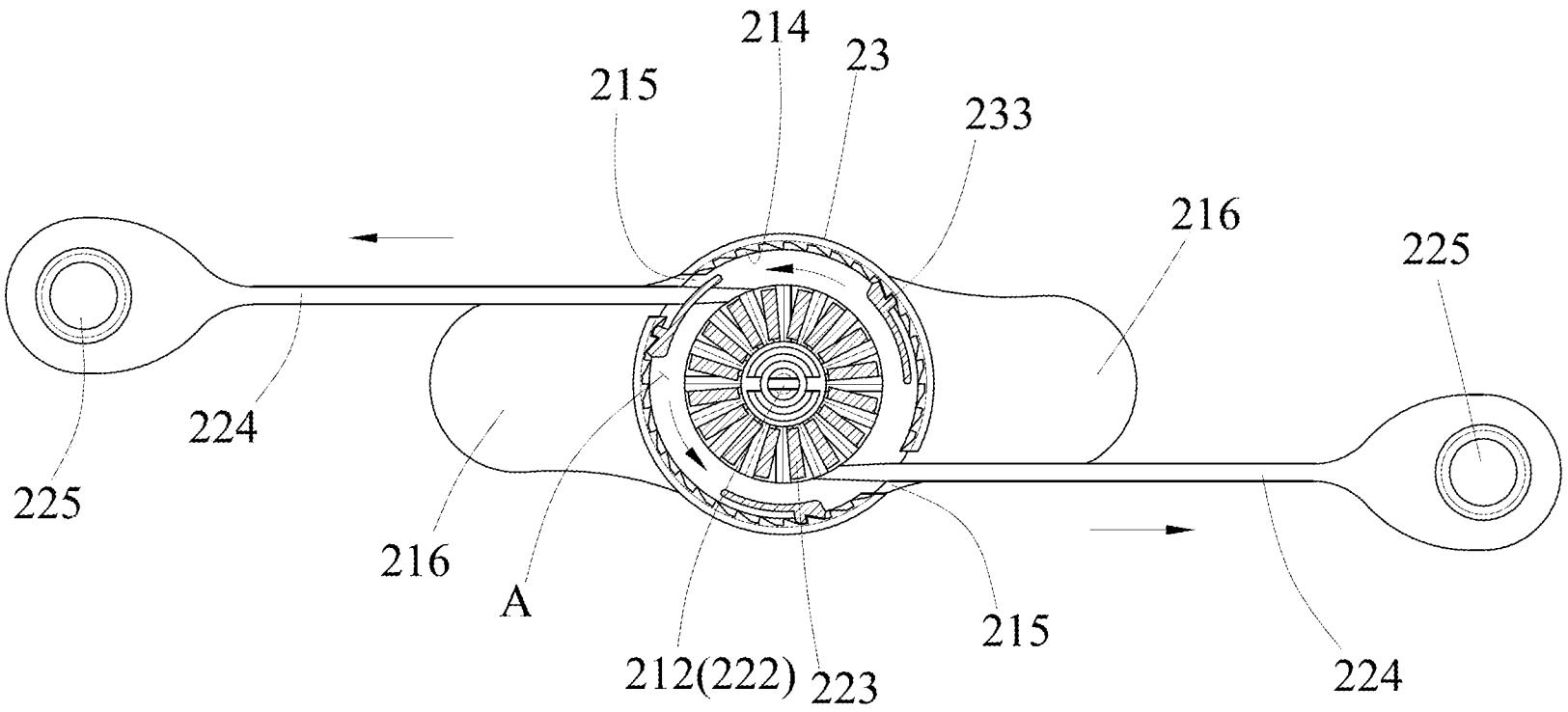
FIG. 7 is a top view of an adjustment assembly being operated and used of an embodiment according to the present invention.

When the length of the connecting strips 224 is too short or a user intends to turn the rotating member 22 back, as shown in FIG. 6 and FIG. 7, the outer cap 24 is pulled up (as shown in FIG. 6) so that the toothed disc 23 is released from the rotating member 22. Namely, the snap portion 221 is released from the mounting hole 231 of the toothed disc 23. Not only the first teeth portion 232 is released from the radial teeth portion 223, the elastic locking tooth portion 233 is also released from the positioning teeth portion 214. As to the outer cap 24, it is pulled up within a certain range due to limitation caused by the protruding locking block 242 being engaged with the circular flange 213 of the base 21. By loose engagement mentioned above, the rotating member 22 can be turned back or the connecting strips 224 can be adjusted to have longer length, as shown in FIG. 7.

Besides extending from and integrated with the rotating member 22, the connecting strip 224 can also be connected to the rotating member 22 in a removable manner or the connecting strip 224 can also be connected to the rotating member 22 or the connecting strip 224 and the rotating member 22 are made of different materials and connected to each other. Two wings 216 are extending from two sides of the base 21 respectively and each of the wings 216 can be attached to the user's head for positioning.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A support frame which includes a forehead section corresponding to a user's forehead, and left and right straps extended from two sides of the forehead section respectively; and an adjustment assembly disposed between the left and right straps for adjustment of length of the left and right straps;

wherein the adjustment assembly includes a base, a rotating member, a toothed disc, and two connecting strips; the base is provided with a mounting space, a positioning pin arranged at the center of the mounting space, a circular flange disposed on an outer wall of the mounting space, a positioning teeth portion formed circularly on an upper part of an inner wall of the mounting space, and two notches formed on two opposite positions of a wall of the mounting space respectively; the rotating member consists of a snap portion at the center thereof, a positioning hole disposed in the snap portion for mounting and positioning the positioning pin therein and allowing the rotating member to be mounted in the mounting space, a radial teeth portion disposed on a surface of one end of the rotating member and located around the snap portion, and the two connecting strips located corresponding to the notches for being mounted into the notches and connected to the left and right straps respectively; the toothed disc is provided with a mounting hole which the snap portion is mounted therein or released therefrom, a first teeth portion arranged around the mounting hole and used being engaged with the radial teeth portion, and at least one elastic locking tooth portion corresponding to the positioning teeth portion; an outer cap covering the base and composed of a plurality of locking and positioning member arranged at an inner wall thereof for fixing the toothed disc therein, a protruding locking block disposed on the inner wall thereof and engaged with the circular flange of the base correspondingly, and indentations on the wall thereof for allowing the connecting strips to pass through, and a head cushion disposed on the forehead section of the support frame; wherein the forehead section includes a straight segment, an upper elastic portion and a lower elastic portion extending upward and downward from the straight segment respectively;

elastic curved portions being formed on connection between the upper elastic portion and the straight segment as well as connection between the lower elastic portion and the straight segment, a room formed between the elastic curved portion and the head cushion, not any portion of the head cushion located in the room, the upper elastic portion is provided with a plurality of upper elastic pieces and an upper notch is formed between the two adjacent upper elastic pieces; the lower elastic portion includes a plurality of lower elastic pieces and a lower notch is formed between the two adjacent lower elastic pieces; the upper notches and the lower notches are arranged in a staggered manner; the left side and the right side of the forehead section are both provided with an upper hole and a lower hole while the head cushion is provided with fasteners for being fastened with the upper and the lower holes correspondingly.

2. The device as claimed in claim 1, wherein a circumference of the toothed disc is provided with a nick while the inner wall of the outer cap is provided with a protruding block corresponding to the nick; the toothed disc is able to rotate along with the outer cap by the protruding block being mounted and locked in the nick.

3. The device as claimed in claim 1, wherein the connecting strip is provided with a connecting hole used for connection with the strap.

4. The device as claimed in claim 1, wherein the connecting strip is extending from the rotating member integrally.

5. The device as claimed in claim 1, wherein two wings are extending from two sides of the base respectively and attached to a user's head for positioning.

6. The device as claimed in claim 1, wherein a circumference of the toothed disc is provided with a nick while the inner wall of the outer cap is provided with a protruding block corresponding to the nick; the toothed disc is able to rotate along with the outer cap by the protruding block being mounted and locked in the nick.

7. The device as claimed in claim 1, wherein the connecting strip is provided with a connecting hole used for connection with the strap.

8. The device as claimed in claim 1, wherein the connecting strip is extending from the rotating member integrally.

9. The device as claimed in claim 1, wherein two wings are extending from two sides of the base respectively and attached to a user's head for positioning.

* * * * *